United States Patent [19]

Julian

[11] Patent Number: 5,056,675

[45] Date of Patent: Oct. 15, 1991

[54] TETHER WEB RATCHET DRIVE TAMPER INDICATING BAND CLOSURE

[75] Inventor: Randall K. Julian, Evansville, Ind.

[73] Assignee: Sunbeam Plastics Corporation, Evansville, Ind.

[21] Appl. No.: 644,013

[22] Filed: Jan. 18, 1991

[51] Int. Cl.[5] ..... B65D 41/34

[52] U.S. Cl. ..... 215/252

[58] Field of Search ..... 215/252, 256

[56] References Cited

U.S. PATENT DOCUMENTS

| | | | |
|---|---|---|---|
| 3,310,191 | 3/1967 | Kern et al. . | |
| 3,415,403 | 12/1968 | Bardell . | |
| 3,650,428 | 3/1972 | Miller . | |
| 3,874,540 | 4/1975 | Hidding | 215/252 |
| 3,904,062 | 9/1975 | Grussen | 215/250 |
| 4,062,466 | 12/1977 | Conti | 215/252 |
| 4,081,097 | 3/1978 | Dold | 215/252 |
| 4,305,516 | 12/1981 | Perne et al. | 215/252 |
| 4,346,811 | 8/1982 | Hilaire | 215/252 |
| 4,394,918 | 7/1983 | Grussen | 215/243 |
| 4,432,461 | 2/1984 | Mumford et al. | 215/252 |
| 4,448,318 | 5/1984 | Lowe | 215/252 |
| 4,530,436 | 7/1985 | Wiedmer | 215/246 |
| 4,545,496 | 10/1985 | Wilde et al. | 215/252 |
| 4,548,329 | 10/1985 | Curry | 215/216 |
| 4,565,295 | 1/1986 | Mori et al. | 215/252 |
| 4,664,278 | 5/1987 | Barriac | 215/252 |
| 4,666,053 | 5/1987 | Corcoran et al. | 215/252 |
| 4,720,018 | 1/1988 | Schetzsle et al. | 215/252 |
| 4,805,792 | 2/1989 | Lecinski, Jr. | 215/253 |

*Primary Examiner*—Stephen Marcus
*Assistant Examiner*—Paul Schwarz
*Attorney, Agent, or Firm*—Gifford, Groh, Sprinkle, Patmore and Anderson

[57] ABSTRACT

A tamper indicating closure for application to a container neck. The closure includes a cap having a top and an internally threaded skirt. A tamper indicating band depends from the bottom of the cap skirt by circumferentially spaced frangible connections. The band has ratchet teeth which engage ratchet teeth on the container neck, and a permanent tether rib connects the band to the cap so that the band remains with the cap when the closure is unthreaded from the container neck.

11 Claims, 2 Drawing Sheets

TETHER WEB RATCHET DRIVE TAMPER INDICATING BAND CLOSURE

BACKGROUND OF THE INVENTION

1. Field of the Invention

This invention relates to tamper indicating closures for application to container necks. The tamper indicating feature indicates that the closure has been previously removed or an attempt has been made to remove it from the container. More particularly, this invention relates to a tamper indicating closure in which a tamper indicating band depends from the bottom of the cap skirt by spaced frangible webs. The band has a stop which coacts with a stop on the container neck so that as the closure cap is being unthreaded from the container neck the tamper indicating band is restrained against axial or rotational movement causing fracture of the frangible webs and separation of the band from the cap.

2. Description of the Related Art

At the present time, one of the most commonly used stop device for restraining the movement of the tamper indicating band on the container neck relative to the cap has been the provision of an inwardly directed bead on the tamper indicating band which coacts with an outwardly directed flange on the container neck. In the process of threading the cap onto the container neck the bead on the tamper indicating band snaps over the flange on the container neck. In the unthreading process the bead is restrained against axial motion by the container flange so that the frangible webs between the bottom of the cap skirt and the top of the tamper indicating band are fractured primarily in tension. There are many shortcomings with this type of tamper indicating band restraint. Among these are skewing of the band so that not all of the tamper indicating webs are broken during the unthreading process. This type of difficulty can be obviated by changing the stops to cooperating ratchet teeth on the tamper indicating band and container neck. In the unthreading direction, radial stop surfaces on the band ratchet teeth abut radial stop surfaces on the container neck ratchet teeth. The frangible webs are thus caused to fracture primarily in shear since the band does not rotate with the cap.

In many instances it is desirable to remove the severed tamper indicating band with the cap rather than have the band remain on the container neck. For example in the case of reusable bottles, it is desirable to remove the tamper indicating band from the container neck so that it will not require additional processing steps in the bottling operation. Likewise, when the closure is applied to a plastic quart oil container, it is desirable to remove the band with the cap to eliminate the possibility of the band sliding off the container neck and into the engine crank case when the container is inverted to allow oil to flow from the container. In the past the retention of the tamper indicating band with the cap has been accomplished with closures of the snap over bead/flange design. When cooperating ratchet teeth have been used, the band has either been left on the container neck or it has been removed separately as a tear strip before there is any attempt to unthread the cap from the container neck.

SUMMARY OF THE INVENTION

The present invention eliminates many of the difficulties encountered in the prior art structures such as the incomplete fracture of all of the frangible webs during removal of the closure from the container neck which can occur in a snap over bead/flange design. This is accomplished in a cooperating ratchet teeth design utilizing a permanent tether rib and providing a unique movement of the tamper indicating band relative to the cap while the closure is being unthreaded from the container neck.

The present invention contemplates a closure design in which the tamper indicating band is removed with the cap after the telltale severence or partial severence of the band takes places during the initial unthreading. Uniquely a flexible permanent rib or web provides relative movement between the cap and the tamper indicating band after the ratchet teeth have become engaged, and this permanent rib provides the means for tethering the band to the cap so that the band is removed and remains with the cap when the closure has been unthreaded. The relative movement first produces fracture of the frangible connections or webs between the tamper indicating band and the cap followed by fracture of the band allowing it to open up for complete removal of the cap and band from the container neck.

The invention provides a tamper indicating closure for use on a container having a threaded neck with circumferentially spaced ratchet teeth below the threads. The closure includes a cap with a top and a depending annular skirt which has threads for engaging the container neck threads. A tamper indicating band is connected to the bottom of the cap skirt by a number of circumferentially spaced frangible connections. These connections usually take the form of a flexible web of finite length. The band contains a number of circumferentially spaced ratchet teeth which engage corresponding ratchet teeth on the container neck. The band has an axially or vertically extending frangible area and a permanent tether rib connects the band to the bottom of the cap skirt downstream from the frangible area in the direction of unthreading.

As the closure is being unthreaded from the container neck, the band ratchet teeth engage the container ratchet teeth to stop relative rotation between the band and the container neck. Pliant means associated with the permanent tether rib permits continuing rotation of the cap so that first the frangible connections will be fractured, and then the band will fracture at the axially extending frangible area allowing the band to open up and the cap to be completely unthreaded from the container neck with the band remaining tethered to the cap by the permanent tether rib.

The axially or vertically extending frangible area on the tamper indicating band can take the form of a single vertical score or spaced overlapping scores, or the band can have an area of reduced height and width forming a membrane or the like. In a preferred embodiment of the invention, the frangible reduced height and width area includes a single or a pair of circumferentially extending frangible webs.

In a preferred embodiment of the invention, the tamper no indicating band has a larger diameter than the annular cap skirt, and the pliant means includes making the permanent tether rib flexible with a radially extending portion which is attached to the cap skirt and an axially extending portion connected to the tamper indicating band. Preferably the axially extending portion of the flexible permanent rib is connected adjacent to the bottom of the tamper indicating band with the pliant means including an axially extending relief slot in the band extending upward from the point of connection The slot is on the downstream side of the tether rib in the direction of cap unthreading. This allows circumferential freedom of movement between the permanent flexible tether rib and the band allowing the rib to flex as the cap is turned relative to the stationary band.

In another preferred embodiment of the invention, the pliant means for supplying movement of the tamper indicating band, after ratchet teeth engagement, takes the form of a circumferentially extending strap or pair of straps joining the downstream side of the permanent tether web to the band. This allows the tamper indicating band to remain tethered to the cap when the cap is completely removed from the container neck even if the permanent tether web is rigid. Again, an axially extending frangible area is provided on the band upsteam from the permanent tether web which can take the form of a circumferentially extending frangible web so that the band will open up to allow continuing unthreading and removal of the closure from the container neck with the band remaining tethered to the cap.

BRIEF DESCRIPTION OF THE DRAWING

The preferred embodiments of the invention are illustrated in the drawing in which:

FIG. 3 shows the closure when the cap has been fully tightened on to the container neck with no stress being introduced into the axial extending frangible webs, the permanent flexible tether rib, or the circumferentially extending frangible webs;

FIG. 4 shows the closure when the cap has been unthreaded in the direction of the arrow past the point where the band ratchet teeth have engaged the container neck ratchet teeth holding the band stationary relative to the container neck with the permanent flexible tether rib having allowed such movement to the point where the axially extending frangible webs have been fractured;

FIG. 5 shows the closure when the cap has been further unthreaded further stretching the circumferentially extending frangible webs with the permanent flexible tether rib reaching its movement limit;

FIG. 6 shows the closure when the cap has been unthreaded to the point where the circumferentially extending frangible webs have been fractured;

DETAILED DESCRIPTION OF THE PREFFERED EMBODIMENT OF THE INVENTION

Figure 1:
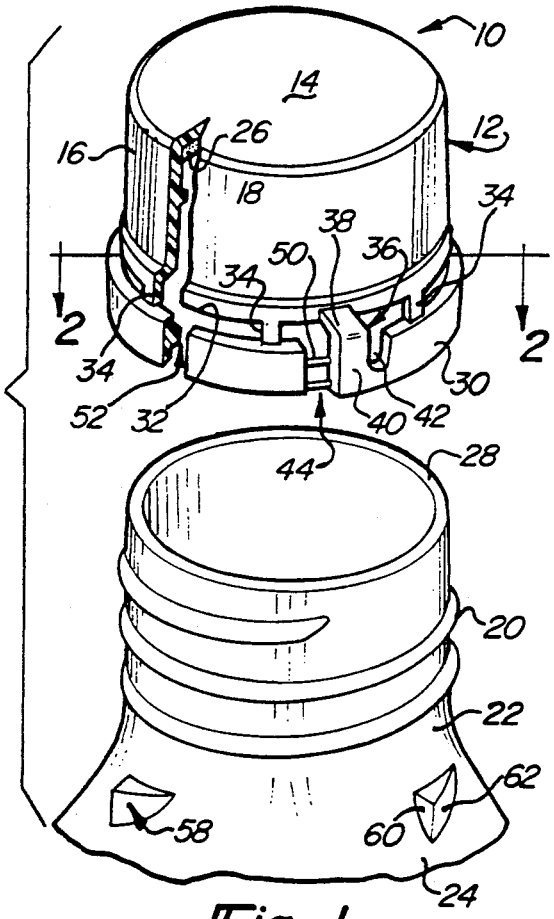
FIG. 1 is an exploded perspective view of the closure of this invention as it will be threaded on to a container neck with a portion of the closure broken away to show the preferred shape of the cap skirt and the depending tamper indicating band as it is connected to the bottom of the cap skirt by frangible connections or webs. The perspective view shows the configuration of a permanent tether rib as it extends radially outward and downward from the bottom of the cap skirt to the tamper indicating band to provide relative movement between the cap and the tamper indicating band when the closure is being unthreaded and ratchet teeth on the tamper indicating band (only one of which is shown in the cut away portion of the closure) engage ratchet teeth on the container neck.

Referring to FIG. 1, the closure 10 of this invention is shown as including a cap 12 having a top 14 and an annular skirt 16 depending from the periphery of the top. The skirt has internal threads 18 which engage external threads 20 on the neck 22 of container 24. Cap 12 has a sealing gasket 26 which is compressed between the top 14 and the lip 28 of the container neck. Other suitable sealing means can be used.

Figure 2:
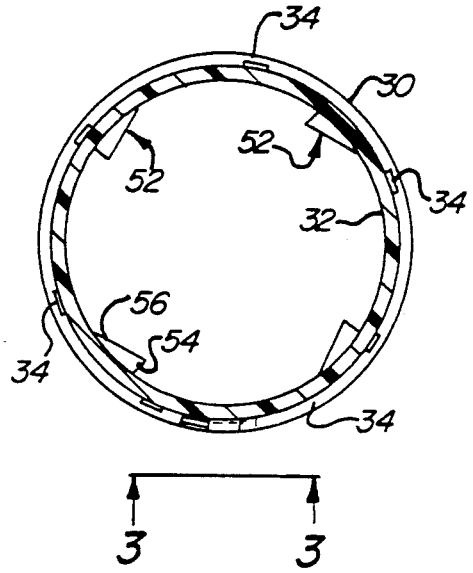
FIG. 2 is a cross sectional view taken along line 2—2 in FIG. 1 showing the tamper indicating band and its ratchet teeth in relationship to the lower portion of the cap skirt with circumferentially spaced frangible webs connecting the cap skirt to the tamper indicating band.

Closure 10 has a tamper indicating band 30 which depends from the enlarged diameter bottom 32 of cap skirt 16 by circumferentially spaced frangible connections or webs 34. As can be seen in FIG. 2 there are seven axially extending frangible webs which are circumferentially spaced around the periphery of the closure but not necessarily evenly spaced. The number of webs used can be varied for different applications and sizes of closures.

The tamper indicating band 30 is also permanently attached to the bottom 32 of cap skirt 16 by a flexible permanent tether rib or web 36 which has a horizontally or radially extending portion 38 and an axially or vertically extending portion 40 to provide the desired flexure in combination with an adjacent axially extending relief slot 42 in the tamper indicating band 30 downstream of the flexible permanent tether rib web 36 in the direction of cap unthreading.

The band 30 has an axially or vertically extending frangible area or section 44 adjacent to and upstream from the flexible permanent web 36. This frangible area can be a reduced thickness portion of the band created, for example, by a continuous score line or by two or more closely adjacent discontinuous score lines. In the embodiments illustrated, the band 30 has a reduced cross section or reduced width and height at 44 creating a pair of frangible webs 50.

The tamper indicating band 30 has a number of spaced inwardly directed ratchet teeth 52. Four equally spaced ratchet teeth are shown. Although functionally, a single ratchet tooth is sufficient, typically two to eight ratchet teeth are provided, depending on the application and size of the closure, and these teeth engage an equal number of ratchet teeth on the container neck. Each tooth has a radial stop surface 54 and a sloped ramp surface 56. The container neck 22 has an equal number of ratchet teeth 58 located below the external thread 20 with each having a corresponding radial stop surface 60 and a sloped ramp surface 62.

Figure 3:
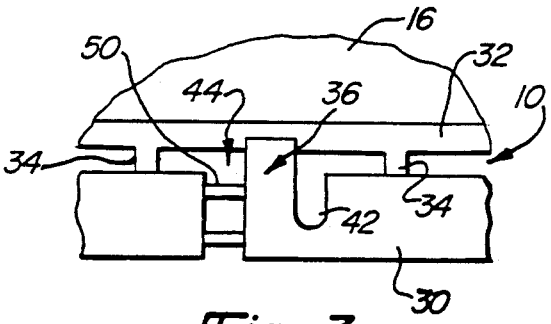
FIG. 3-6 are partial elevational views taken in the direction of line 3—3 in FIG. 2 showing the axially or vertically extending frangible area of the tamper indicating band, in the form of an area of reduced height and width in the band creating a pair of circumferentially extending frangible webs, a flexible permanent tether rib and two of the axially extending frangible connections in the form of frangible webs joining the cap skirt to the tamper indicating band, from the tightened condition of the closure on the container neck through successive stages of unthreading of the closure; the further showing in these FIGS. being as follows.

As with a conventional tamper indicating closure having a depending tamper indicating band with ratchet teeth for engagement with ratchet teeth on a container neck, when the cap of the closure 10 is being threaded onto the container neck 22, the ramp surfaces 56 of the band ratchet teeth 52 will engage the ramp surfaces 62 of the container neck ratchet teeth 58 to permit the band ratchet teeth 52 to pass over the container neck ratchet teeth 58. Likewise, in the unthreading direction, the stop surfaces 54 of the band ratchet teeth 52 will engage the stop surfaces 60 of the container neck ratchet teeth 58 to prevent further rotation of the tamper indicating band 30 relative to the container 24. The permanent flexible tether rib 36 and its adjacent relief slot 42 allows the cap 12 to be further rotated in the unthreading direction while the tamper indicating band 30 remains stationary relative to the container neck. FIG. 3 shows the condition of the flexible permanent tether rib 36 and the frangible webs 34 and 50 when the closure 10 is in its fully tightened position on the container neck through to the point in which the closure has been rotated so that the band stop surfaces have engaged the container neck stop surfaces 60. At this point there has been no stress introduced into the band, flexible permanent tether rib or the frangible webs.

Since the tamper indicating band 30 is to remain tethered to the cap 12, the flexible tether rib 36 must yield enough to provide movement of the cap 12 relative to the band 30 for fracture of all the axially extending frangible webs 34 followed by fracture of the circumferentially extending frangible webs 50.

Figure 4:
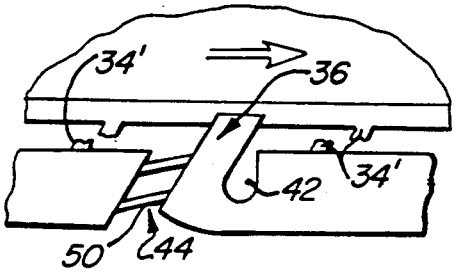

Referring to FIG. 4 as the cap 12 is further turned in the unthreading direction after the band ratchet teeth 52 have engaged the container neck ratchet teeth 58, the band 30 will remain stationary with respect to the container neck, but the cap will turn relative to the band so that the permanent flexible tether rib 36 will flex or become distorted allowing this relative movement until the axially extending frangible webs 34 will become fractured as shown at 34'. Also the circumferentially extending webs 50 will be flexed, but very little tension will be applied to them during this initial rotation past the point of ratchet teeth engagement. The sector of the tamper indicating band 30 between the band ratchet tooth 52 trailing the permanent flexible tether rib 36 and the rib 36 itself is free to flex from its initial arcuate shape to a chordal shape or to a pair of chords with an intermediate arc of a smaller radius against the container neck thus providing some slack in that sector.

Figure 5:
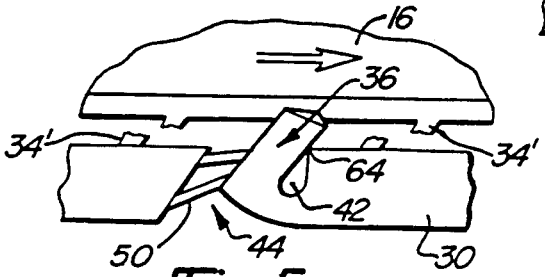

Continuing rotation in the direction of the arrow as shown in FIG. 5 will further flex the permanent flexible web 36 so that the relief provided by slot 42 will be taken up and the edge of the permanent web will contact the upper portion of the band, as shown at 64, acting as a stop for this movement. The circumferentially extending frangible webs 50 will now be put under fracturing tension so that additional rotation of the cap in the direction of the arrow as shown in FIG. 6 will fracture these webs as shown at 50'.

Figure 6:
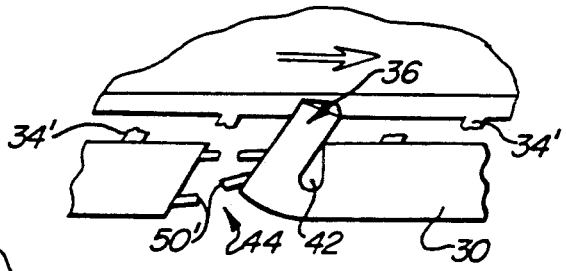
Figure 7:
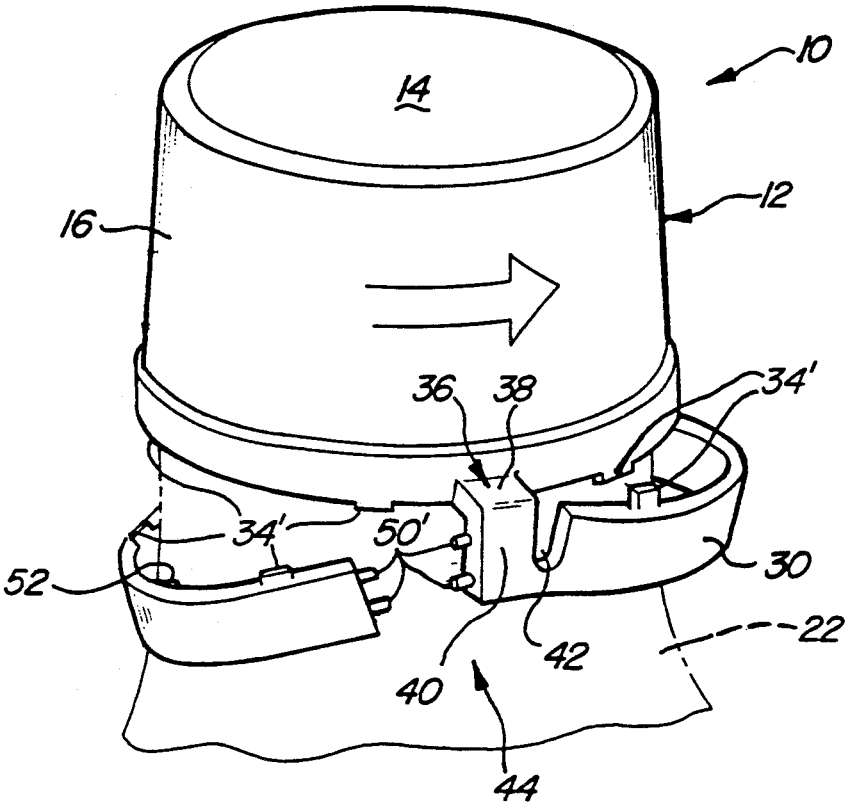
FIG. 7 is a perspective view of the closure with the tamper indicating band opened up but remaining tethered to the bottom of the cap skirt so that the closure can be completely unthreaded from the container neck.

Fracture of the circumferentially extending webs 50 as shown at 50' in FIGS. 6 and 7 allow the band to open up so that the closure 10 can be easily completely unthreaded from the container neck as shown in FIG. 7.

Figure 8:
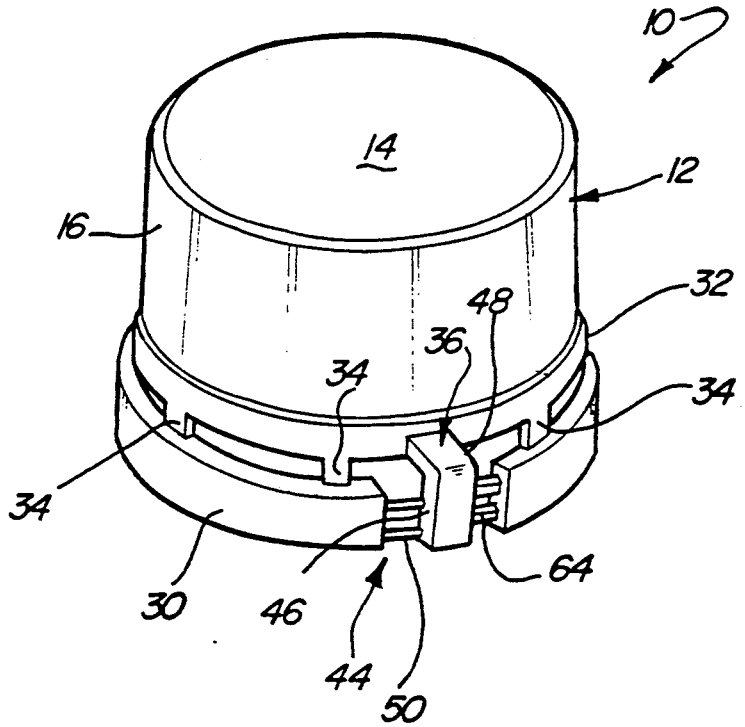
FIG. 8 is a perspective view of another embodiment of the closure of this invention in which the permanent tether web is rigid, and flexibility is provided for movement of the cap relative to the tamper indicating band after the ratchet teeth engagement by circumferentially extending flexible straps.

In the embodiment of the invention of FIG. 8 pliancy in the tether connection of the cap and tamper indicating band is not obtained in the flexibility and configuration of the tether rib 36 itself but rather in the connection of the tether rib to the band. The axially extending frangible area 44 in the band is created in the same manner as the embodiment of FIGS. 1–7 by the circumferentially extending frangible webs 50 which attach to the upstream side 46 of the permanent tether rib 36. The downstream side 48 of tether web 36 is connected to the tamper indicating band 30 by a pair of circumferentially extending flexible straps 64. Thus the straps 64 provide the pliant means for rotation of the cap 14 relative to the stationary tamper indicating band 30 for sequential fracture of the axially extending frangible webs 34 simultaneously followed by fracture of the circumferentially extending frangible webs 50.

All the embodiments of the invention whether specifically delineated or not maintain the tethering of the tamper indicating band with the cap while providing the sure arresting of the band relative to the container neck by cooperating ratchet teeth.

The embodiments of the invention in which an exclusive property or privilege is claimed are defined as follows:

1. A tamper indicating closure for use on a container having a threaded neck with circumferentially spaced ratchet teeth below the threads, said closure comprising:

a cap with a top and a depending annular skirt having threads for engaging the container neck threads;

a tamper indicating band connected to the bottom of said cap skirt by a plurality of circumferentially spaced frangible connections;

a plurality of circumferentially spaced ratchet teeth on said band for engagement with ratchet teeth on the container neck;

said band having an axially extending frangible area;

a permanent tether rib connecting said band to the bottom of said cap skirt, said rib being located downstream from said frangible area in the direction of cap unthreading; and pliant means associated with said tether rib which allows relative rotation between said cap and said band;

wherein as the closure is being unthreaded from the container neck, the band ratchet teeth engage the container neck ratchet teeth to stop relative rotation between the band and the container neck, and said pliant means permits continuing rotation of said cap which causes fracture of said frangible connections with substantially no axial tension applied to or axial stretching of said frangible connections followed by fracture of said axially extending frangible area allowing the band to open up and the cap to be completely unthreaded from the container neck with the band remaining tethered to said cap through said permanent tether rib.

2. The tamper indicating closure according to claim 1 wherein said tamper indicating band has a larger diameter than said annular skirt and said pliant means includes providing said permanent rib with flexibility and a radially extending portion attached to said cap skirt and an axially extending portion connected to said tamper indicating band.

3. The tamper indicating closure according to claim 2 wherein the axially extending portion of said permanent tether rib is connected adjacent the bottom of said tamper indicating band and said pliant means further includes an axially extending relief slot in said band extending upward from the point of connection.

4. The tamper indicating closure according to claim 1 wherein said axially extending frangible area includes an area of reduced height and width with at least one circumferentially extending frangible web adjacent and upstream from said permanent tether rib in the direction of cap unthreading.

5. The tamper indicating closure according to claim 4 wherein said pliant means includes an area of reduced height and width with at least one circumferentially extending permanent flexible strap contiguous to the downstream side in the direction of cap unthreading of said permanent tether rib.

6. A tamper indicating closure for use on a container having a threaded neck with circumferentially spaced ratchet teeth below the threads, said closure comprising:

a cap with a top and a depending annular skirt having threads for engaging the container neck threads;

a tamper indicating band connected to the bottom of said cap skirt by a plurality of circumferentially spaced frangible connections;

a plurality of circumferentially spaced ratchet teeth on said band for engagement with ratchet teeth on the container neck;

said band having an axially extending frangible area; and a flexible permanent tether rib connecting said band to the bottom of said cap skirt, said rib being located adjacent and downstream from said frangible area in the direction of cap unthreading allowing relative rotation between said cap and said band;

wherein as the closure is being unthreaded from the container neck, the band ratchet teeth engage the container neck ratchet teeth to stop relative rotation between the band and the container neck, and flexure of said flexible permanent tether rib permits continuing rotation of said cap which causes fracture of said frangible connections with substantially no axial tension applied to or axial stretching of said frangible connections followed by fracture of said axially extending frangible area allowing the band to open up and the cap to be completely unthreaded from the container neck with the band remaining tethered to said cap by said flexible permanent tether rib.

7. The tamper indicating closure according to claim 6 wherein said axially extending frangible area includes an area of reduced height and width with at least on circumferentially extending frangible web upstream from said flexible permanent tether rib in the direction of cap unthreading.

8. The tamper indicating closure according to claim 6 wherein said tamper indicating band has a larger diameter than said annular skirt and said flexible permanent tether rib has a radially extending portion attached to said cap skirt and an axially extending portion connected to said tamper indicating band.

9. The tamper indicating closure according to claim 8 wherein the axially extending portion of said flexible permanent tether rib is connected adjacent the bottom of said tamper indicating band with an axially extending relief slot in said band extending upward from the point of connection.

10. A tamper indicating closure for use on a container having a threaded neck with circumferentially spaced ratchet teeth below the threads, said closure comprising:

a cap with a top and a depending annular skirt having threads for engaging the container neck threads;

a tamper indicating band connected to the bottom of said cap skirt by a plurality of circumferentially spaced frangible connections;

a plurality of circumferentially spaced ratchet teeth on said band for engagement with ratchet teeth on the container neck;

a permanent tether rib connecting said band to the bottom of said cap skirt, said rib having an upstream and downstream side in the direction of cap unthreading, said downstream side being connected to said band by a circumferentially extending permanent flexible strap which allow relative rotation between said cap and said band and said upstream side being connected to said band by at least one or more circumferentially extending frangible webs.

wherein as the closure is being unthreaded from the container neck, the band ratchet teeth engage the container neck ratchet teeth to stop relative rotation between the band and the container neck, and said flexible strap permits continuing rotation of said cap which causes fracture of said frangible connections with substantially no axial tension applied to or axial stretching of said frangible connections followed by fracture of said circumferentially extending frangible webs allowing the band to open up and the cap to be completely unthreaded from the container neck with the band remaining tethered to said cap through said permanent tether rib and flexible strap.

11. The tamper indicating closure according to claim 10 wherein the downstream side of said rib is connected to said band by a pair of axially spaced circumferentially extending permanent flexible straps and the upstream side of said rib is connected to said band by a pair of axially spaced circumferentially extending frangible webs.

* * * * *